United States Patent [19]

Seeger

[11] 4,422,525

[45] Dec. 27, 1983

[54] MUFFLER

[75] Inventor: Walter Seeger, Gaggenau, Fed. Rep. of Germany

[73] Assignee: Roth-Technik GmbH, Gaggenau, Fed. Rep. of Germany

[21] Appl. No.: 263,995

[22] Filed: May 15, 1981

[30] Foreign Application Priority Data

May 29, 1980 [DE] Fed. Rep. of Germany ..... 3020492

[51] Int. Cl.[3] ..... F01N 1/08

[52] U.S. Cl. ..... 181/255; 181/264; 181/268; 181/272

[58] Field of Search ..... 181/243, 247, 255, 265, 181/268, 272, 281

[56] References Cited

U.S. PATENT DOCUMENTS 3,100,140 8/1963 Ashley et al. ..... 181/268 X 4,203,502 5/1980 Strader ..... 181/265 X

*Primary Examiner*—Benjamin R. Fuller

*Attorney, Agent, or Firm*—Max Fogiel

[57] ABSTRACT

A muffler for combustion engine in which a housing is subdivided into at least two successive reflection chambers. An exhaust gas inlet pipe enters the first input reflection chamber, and intermediate channels are provided for communicating between the reflection chambers. An exhaust gas outlet pipe terminates in the last reflection chamber. A corrugated metal sheet is provided on the inner side of the housing, and cooperates with that inner side so that each corrugation of the metal sheet forms an intermediate channel with the inner side of the housing. The region of the opening of the exhaust gas inlet and outlet pipes is surrounded by a respective chamber housing. Each chamber housing forms a closed reflection chamber and abuts the inner side of the corrugated metal sheet to form a plurality of mutually separated guide channels.

18 Claims, 4 Drawing Figures

MUFFLER

The invention relates to a muffler according to the preamble of claim 1.

Mufflers are known in a multiplicity of embodiments. There are, for example, those which operate on the principle of absorption muffling, where the exhaust gas is supplied via pipes which are provided on their circumference with holes through which the sound pressure wave can issue uniformly distributed and is muffled to a certain extent by rock wool surrounding these pipes. These absorption-type mufflers are e.g. used as main mufflers (German OS No. 2,257,854)—also called resonators—to dampen in particular the high-frequency noise part of the emitted exhaust gases.

Besides these absorption-type mufflers, others according to the preamble of claim 1—so-called reflection-type mufflers—have also become known. In these, similar to the absorption type, the exhaust gas is admitted through an "inlet shower", i.e. a body having a plurality of openings, to enter into reflection chambers and is then conducted into various other reflection spaces by different tubes, from where the exhaust gas can issue via openings (e.g. perforated pipes) to finally flow to the exterior via the exhaust gas outlet pipe.

Thus, the principle used in reflection mufflers is that the sound is reduced by changes in cross-section and path deflections.

Due to the different reactance in the individual elements a reflection of the sound energy takes place and primarily dampens the low-frequency range.

Disadvantageous in these known mufflers are the transitions between the pipes and the reflection chambers which result in a high flow resistance and thus back-up to the engine. Beyond this, only certain frequencies can be effectively damped, partly dependent upon the dimensions of the muffler, especially insofar as high-frequency components are concerned.

In order not to reduce the engine effectiveness too much it is necessary, to obtain a lower gas back-pressure, to make the cross-section of the pipes in reflection mufflers comparatively large.

However, since the pipes extend within the reflection chambers, the chamber space needed for the reflection becomes too small, which in turn results in poor muffling of the noise components of different frequencies. For this reason the dimensions of the conventional reflection chambers must be made larger.

This therefore requires a larger dimensioning of the muffler to obtain the same muffling effects as with the absorption muffler, which in turn requires more material to be used and makes the heretofore known reflection mufflers more expensive.

It is further of particular disadvantage that different engines of a series have different frequency spectra which must be muffled. In the heretofore known reflection mufflers this requires different construction sizes, which are necessary even for engines of a series, e.g. with different power, and which are therefore disadvantageous and undesired in a high degree.

The purpose of the invention is to provide a muffler according to the preamble of claim 1, with good damping of as broad as possible a frequency range, especially the high frequency component without increased power loss, at small structural dimensions and low body sound radiation, and to make the muffler such that it can be used for different engines without great effort.

This task is met, according to the invention, in a muffler according to the preamble of claim 1 by the characterizing features thereof.

Because of the arrangement of a corrugated and furthermore curved, preferably bipartite metal sheet at the inner side of the housing, a plurality of mutually parallel intermediate channels is obtained which, in relation to the cross-section of the exhaust gas inlet pipe, have a large total cross-section so that flow through these intermediate channels from the input-side through several others to the output-side reflection chamber causes only a very low flow resistance so that no or only negligibly small power losses result.

The exhaust gas inlet and outlet pipes, which are surrounded by a closed chamber housing, thereby also form a reflection chamber. The reflection chamber housing abuts the inner side of the corrugated metal sheet, so that the corrugations of the sheet define with the corrugations of the reflection chamber housing a plurality of mutually separated guide channels, which are connected via passage openings with the inner space of the reflection chamber housing.

Thus the exhaust gas entering the reflection chamber housing can be conducted via the passage holes and the guide channels into the further reflection chambers outside the reflection chamber. Only from this reflection chamber will the exhaust gas be conducted via the intermediate chamber into the further reflection chambers from which the exhaust gas ultimately flows into the exhaust gas outlet pipe.

The multiplicity of reflection chambers and the many small flow channels result in a good damping effect of the high-frequency noise component especially because the wall surface of all channels combined is larger by a multiple than what is known from the state of the art. In addition to the high friction value due to the large wall surface the flow elements can be tuned with the reflection chambers via passage openings, in such a manner that it is advantageous for damping low-frequency noise components, with the power of the combustion engine being not or only negligibly affected.

Furthermore, due to the use of a multiplicity of reflective chambers a compact construction is obtained. The body sound radiation of the muffler housing hardly exists any more, due to the parallel abutting intermediate channels. Finally, the exhaust gas condensate which forms in every muffler is transported out of the housing by the exhaust gas after only a short operating time of the inventive muffler, since the flow channels are always arranged at the lowest point of the muffler so that according to the teaching of the invention a lesser corrosion formation and thus an increased lifetime of the muffler are to be expected.

Of particular advantage in the invention are the components of the muffler, which are constructed according to the kit system. Thus, accommodation to different engines having different power can in simple manner be affected by providing tuning openings at the chamber housing and/or the inlet region of the corrugated metal sheet and/or the part of the exhaust gas inlet pipe located in the housing.

Advantageous embodiments and developments of the invention are characterized in the sub-claims.

A preferred embodiment of the invention is set forth in the following description as illustrated in the drawing.

Figure 2:
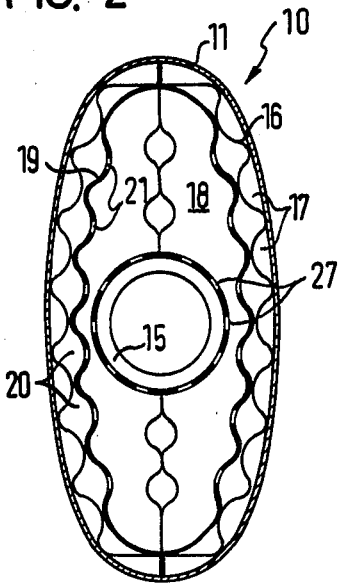
FIG. 2 shows a section on line II—II of FIG. 1.

The muffler which is designated in toto with 10 has a housing 11 which is closed by an outer first bottom 12 and an outer second bottom 13. Through these two bottoms 12, 13 the exhaust gas inlet pipe 14 and the exhaust gas outlet pipe 15 are led in respectively out, in this embodiment approximately in the central region of the bottom which is of oval cross-section (FIG. 2).

A metal sheet 16, provided with a multiplicity of corrugations and extending over the entire length of the housing, abuts the inner side of the housing 11 and terminates with spacing from the respective bottoms 12, 13. The corrugated metal sheet 16 and the inner side of the housing 11 form a plurality of intermediate channels 17.

The exhaust gas outlet pipe 15 is surrounded by a chamber housing 19 forming a closed last reflection chamber 18, which is of two-part construction and can be so inserted into the one shell of the like-wise two-part housing 11 that it contacts the corrugated metal sheet 16. This forms between the jacket of the chamber housing 19 and the inner side of the metal sheet 16 a plurality of mutually separated guide channels 20 which extend parallel to the intermediate channels 17.

The outlet-side chamber housing 19 has passage holes 21 which communicate with the guide channels 20. Further, the outlet-side chamber housing 19 is arranged with spacing from the second housing bottom 13 under formation of an auxiliary reflection chamber 22. Also, on the side of the chamber housing 19 opposite the reflection chamber 22, with spacing therefrom, there is provided a divider wall 23 whereby a further auxiliary reflection chamber 24 is formed.

The exhaust gas outlet pipe 15 has, in the region of the reflection chamber 24, a group of passage holes 25. Also, in the region of the reflection chamber 22 a series of passage holes 26 is provided. Two groups of passage holes 27, 28 are also provided in the inner space of the outlet-side chamber housing 19. The gas outlet pipe 15 extends to the divider wall 23 and is sealed by the same.

On the side of the divider wall 23 facing away from the outlet-side chamber housing 19, an inlet-side first reflection chamber housing 29 is inserted which corresponds essentially to the outlet chamber housing 19; both chamber housings 19, 29 and the guide channels 20 are enlarged in cross-section in that the wall surface of the chamber housing is also corrugated, such that a depression of the corrugated metal sheet 16 contacts a raised part of the chamber housing 19 (compare FIG. 2). The inlet-side chamber housing 29 differs from the chamber housing 19 only in that the exhaust gas pipe is not fully extended through it, but terminates only at one side and in the interior of the chamber housing 29 in bevelled form 30. Further, the inlet-side chamber 29 has a spacing from the housing bottom 12 under formation of a second reflective chamber 31.

The corrugated metal sheet 16 has in the region of the chamber 31 additional openings 32 just as additional openings 33 are provided in the region of the reflective chamber 24 and additional openings 34 in the reflective chamber 22.

Figure 1:
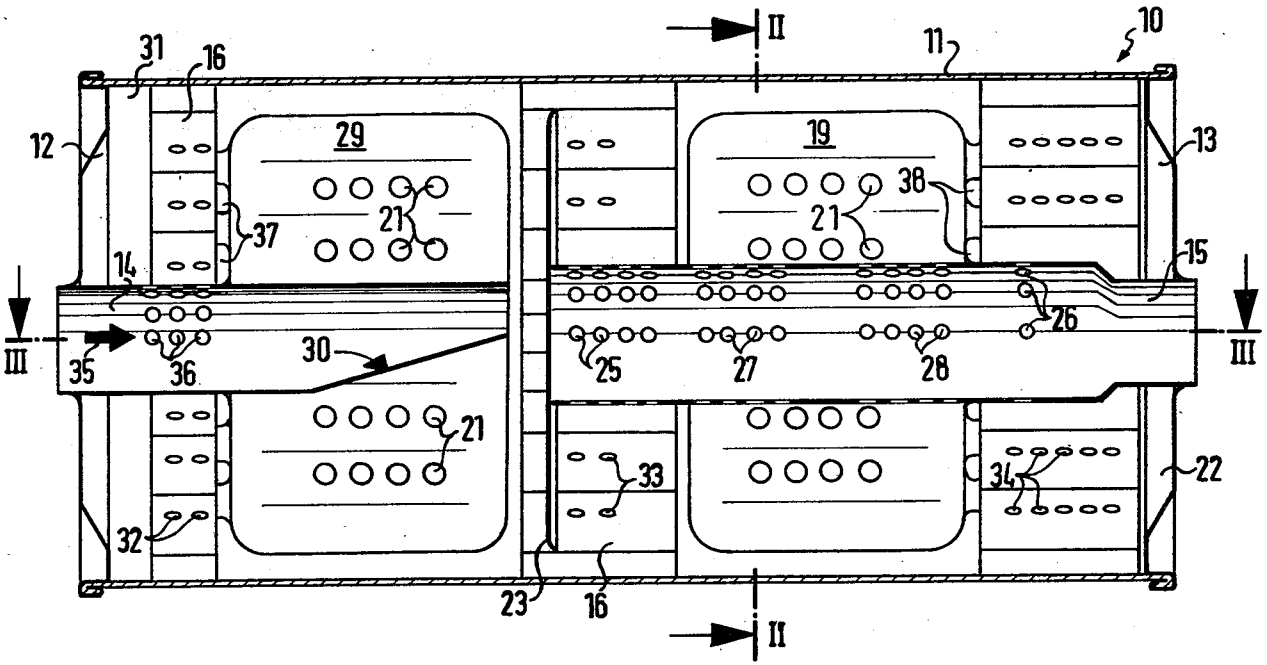
FIG. 1 shows the inventive muffler in a diagrammatic cross-section.
Figure 4:
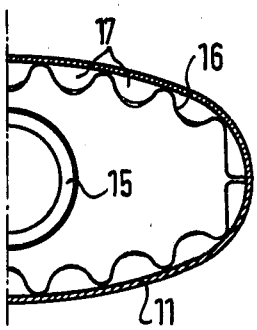
FIG. 4 shows a section on line IV—IV of FIG. 1.
Figure 3:
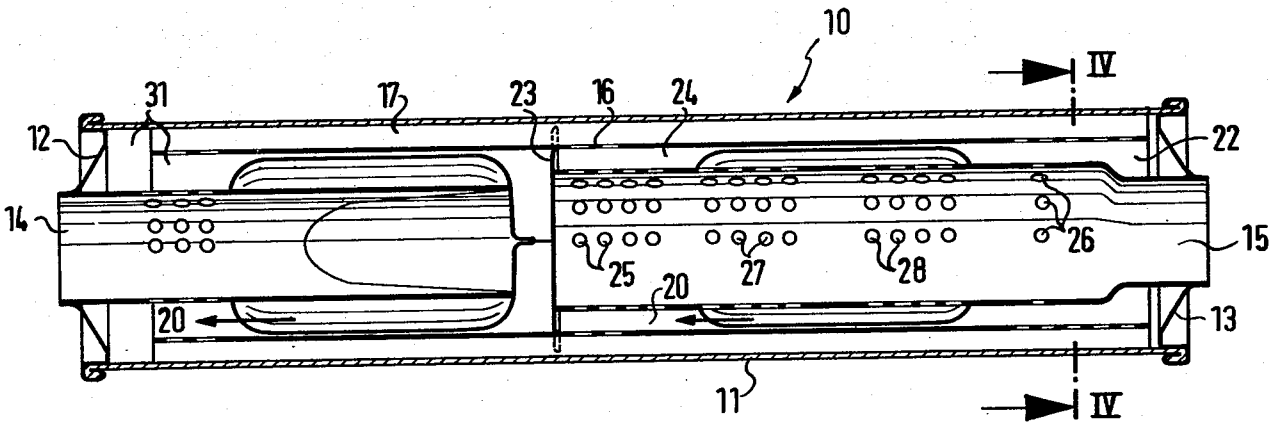
FIG. 3 shows a section on line III—III of FIG. 1.

The exhaust gas flowing into the gas inlet pipe 14 in the direction of arrow 35 (FIG. 1) enters through the bevelled end 30 into the interior of the inlet-side chamber housing 29 and passes through the passage holes 21 thereof into the guide channels 20 (FIG. 3) and the reflection chamber 31. From there the gas is deflected and in part enters via the openings 32 into the channels 17 and is guided to the chamber 22 where it can additionally exit via the openings 34. From there it travels via the guide channels 20 (FIG. 2) and the passage holes 21 on the one hand into the reflection chamber 18 of the chamber housing 19, and on the other hand into the reflection chamber 24. Both from the reflection chamber 24 and from the reflection chamber 18 of the chamber housing 19 the exhaust gas travels via passage holes 25, 27, 28, respectively, into the exhaust gas outlet pipe 15. A part of the exhaust gas can also travel from chamber 22 directly via the passage holes 26 into the exhaust gas outlet pipe.

Additionally to the here illustrated opening and passage holes, further so-called tuning openings serving for tuning, may be provided as this is e.g. the case by means of the passage holes 36 on the jacket of the exhaust gas inlet pipe 14 in the region of the reflection chamber 31. Additionally, the two-part chamber housings 19, 29 may also have tuning openings 37, 38 in the region of their supporting surface.

I claim:

1. Muffler for muffling sound of combustion engines with a housing which is subdivided into at least two successive reflection chambers, an exhaust gas inlet entering a first one of said reflection chambers, intermediate channels for communication between the reflection chambers, an exhaust gas outlet pipe terminating in the last one of said successive reflection chambers, an inner side of said housing having at least one metal sheet accommodated to the curvature of said housing and having a plurality of corrugations, each corrugation and said inner side of said housing forming an intermediate channel, said exhaust gas inlet and outlet pipes having openings with regions surrounded by a respective reflection chamber, each reflection chamber forming a closed chamber and abutting the inner side of the corrugated metal sheet and forming a plurality of mutually separated guide channels, each intermediate channel having a cross-section which is smaller than the cross-section of said gas inlet pipe, the sum of cross-sectional areas of all intermediate channels being greater than the cross-sectional area of said inlet pipe, so that flow through the intermediate channels from input side to output side has substantially low flow resistance to reduce power losses and increase damping of high-frequency noise components, exhaust gas condensate forming in the muffler being transported out of the housing by the exhaust gas after a substantially short operating time.

2. Muffler according to claim 1, wherein said housing, corrugated metal sheet and reflection chambers are of at least two-part construction; said housing, said metal sheet and reflection chambers having a substantially oval cross-section; a first rejected chamber being spaced from an outer first housing bottom by a second reflection chamber; said first reflection chamber being opposite said second reflection chamber and a dividing wall arranged for closing guide channels thereof; said exhaust gas inlet pipe having a bevel opening into the first reflection chamber; said first reflection chamber having passage holes on a side facing towards said corrugated metal sheet; said passage holes being arranged only in the region facing towards the dividing wall; said corrugated metal sheet terminating with spacing from a first and a second outer housing bottom; said corrugated metal sheet having a plurality of additional openings in the region of its ends.

3. Muffler according to claim 1, wherein said housing, the corrugated metal sheet and the reflection chambers are of at least two-part construction.

4. Muffler according to claim 3, wherein said housing, said metal sheet and the reflection chambers have a substantially oval cross-section.

5. Muffler according to claim 1, wherein said first reflection chamber is spaced from an outer first housing bottom by a second reflection chamber.

6. Muffler according to claim 5, wherein said first reflection chamber is opposite said second reflection chamber, and a dividing wall arranged for closing guide channels thereof.

7. Muffler according to claim 5, wherein said exhaust gas inlet pipe has a bevel opening into said first reflection chamber.

8. Muffler according to claim 5, wherein said first reflection chamber has passage holes on a side facing towards said corrugated metal sheet.

9. Muffler according to claim 8, wherein said passage holes are arranged only in the region facing towards a dividing wall.

10. Muffler according to claim 1, wherein the corrugated metal sheet terminates with spacing from a first and a second outer housing bottom.

11. Muffler according to claim 10, wherein in the region of its ends the corrugated metal sheet has a plurality of additional openings.

12. Muffler according to claim 6, wherein on a side of the dividing wall opposite said first reflection chamber there is arranged said last reflection chamber which is spaced from said dividing wall and an outer second housing bottom by auxiliary reflection chambers.

13. Muffler according to claim 12, wherein said last reflection chamber has passage holes on a side facing towards the metal sheet.

14. Muffler according to claim 13, wherein said passage holes are provided only in the region facing towards said dividing wall.

15. Muffler according to claim 28, wherein said exhaust gas outlet pipe penetrates the entire last reflection chamber and extends to said dividing wall.

16. Muffler according to claim 1, wherein said exhaust gas outlet pipe is formed of two concentric pipes having passage holes in their walls.

17. Muffler according to claim 12, wherein said outer exhaust gas outlet pipe has groups of passage holes in a region of an auxiliary reflection chamber and in a region of the last reflection chamber.

18. Muffler according to claim 1, wherein said exhaust gas inlet and outlet pipes, the first and last reflection chambers and the corrugated metal sheet have tuning openings.

* * * * *